US006083058A

United States Patent [19]

Fujiwara

[11] Patent Number: 6,083,058

[45] Date of Patent: Jul. 4, 2000

[54] DOUBLE-LOCK CONNECTOR

[75] Inventor: Yoshihito Fujiwara, Tokyo, Japan

[73] Assignee: The Whitaker Corporation, Wilmington, Del.

[21] Appl. No.: 09/308,312

[22] PCT Filed: Nov. 20, 1997

[86] PCT No.: PCT/US97/21498

§ 371 Date: May 13, 1999

§ 102(e) Date: May 13, 1999

[87] PCT Pub. No.: WO98/24150

PCT Pub. Date: Jun. 4, 1998

[30] Foreign Application Priority Data

Nov. 26, 1996 [JP] Japan ..... 8-330457

[51] Int. Cl.[7] ..... H01R 13/514

[52] U.S. Cl. ..... 439/752; 439/595

[58] Field of Search ..... 439/752, 744, 439/595

[56] References Cited

U.S. PATENT DOCUMENTS 5,326,287 7/1994 Hamakita et al. ..... 439/752
5,489,224 2/1996 Schwarz ..... 439/752
5,538,445 7/1996 Grzybowski et al. ..... 439/752
5,775,957 7/1998 Fink et al. ..... 439/752
5,967,859 10/1999 Cecil, Jr. et al. ..... 439/752

*Primary Examiner*—Michael L. Gellner
*Assistant Examiner*—Antoine Ngandjui

[57] ABSTRACT

A double-lock connector includes a double-lock member, which can be used for locking the contacts in contact cavities arranged in a staggered pattern and which provides for a smooth operation when the double-lock member is shifted from a temporary-latched position to a fully-latched position. The double-lock member 50 has two elongated arms 51*a*, 51*b* which can slide along the outer surfaces of side walls of an inner housing 20. Along the elongated arms 51*a*, 51*b*, locking members 60are provided, which are arranged at fixed intervals in a longitudinal direction and facing inside. The cross section of the locking members 60 is of an L-shaped configuration and they lock electrical contacts 100 in contact cavities 30 when the double-lock member is in the fully-latched position. Along outside surfaces of the housing 20, grooves 28 of L-shaped cross section are formed into which the latching members 60 are disposed. Due to the fact that the latching members 60 are disposed within the grooves 28, the arms 51*a*, 51*b* are retained against outer surfaces of side walls of the inner housing 20 when the double-lock member 50 is moved therealong.

8 Claims, 4 Drawing Sheets

85
80
90
20
25
31
24
30
23
27
22
21
29
28
1
63
51b
51a
50
53a
53b
52
10
95

DOUBLE-LOCK CONNECTOR

FIELD OF THE INVENTION

This invention relates to double-lock connectors which are equipped with a double-lock member mounted on a housing in a movable manner which can slide from a temporary-latched position in which electrical contacts can be inserted in contact cavities of the housing to the completely-latched position securing the inserted contacts in place therein.

BACKGROUND OF THE INVENTION

An example of a known double-lock connector is disclosed in the Japanese Patent Disclosure No. 89-54678. The double-lock member of the double-lock connector has a flat-insertion pin formed at a predetermined location along the length of the connecting strip along which latching lugs are formed whose purpose is to lock the contacts in position. The contacts are inserted inside the contact cavities when the double-lock member is in the temporary-latched position, and after the contacts are inserted in the contact cavities, they are locked therein by sliding the double-lock member into the fully-latched position. Since the contacts are locked in position by the double-lock member, they are reliably retained in the contact cavities.

However, the double-lock member of the known double-lock connector described above is suitable only for the cases when the cavities accommodating the contacts are arranged in lengthwise rows, and cannot be used in other configurations, for example, in connectors with a staggered arrangement of contacts.

SUMMARY OF THE INVENTION

Therefore, the purpose of the present invention is to provide a double-lock connector having a double-lock member which can be used in connectors having contact cavities arranged in a straight or staggered pattern. It is also desirable that the sliding of the double-lock member from the temporary-latched position to the fully-latched position is conducted smoothly and reliably, and that the design of the connector is relatively simple.

The present invention is directed to a double-lock connector having a double-lock member mounted on a housing in such a manner that it can slide in a direction perpendicular to contact cavities in the housing from a temporary-latched position in which electrical contacts can be inserted in the contact cavities of the housing to a fully-latched position in which the contacts become locked therein. The double-lock member has elongated arms sliding along outer surfaces of side walls of the housing which extend in a direction of the double-lock member movement on which locking members of L-shaped cross section are arranged at predetermined intervals from each other locking the contacts in position when the arms are in their fully-latched position, and by the fact that L-shaped grooves are formed on the outer surfaces of the side walls of the housing of such a cross section that the grooves can accommodate the locking members, securing the arms on the outer surfaces of the side walls of the housing by virtue of engagement between the locking members and the grooves when the fully-lock member is moved to the fully-latched position.

A double-lock connector comprises a housing having contact cavities for receiving electrical contacts therein, a double-lock member mounted on the housing for locking the electrical contacts in the contact cavities, wherein the double-lock member has an elongated arm slidable along an outer surface of the housing from a temporary-latched position to a fully-latched position, locking members on an inside surface of the double-lock member at spaced intervals therealong and having first portions permitting insertion of the electrical contacts in the contact cavities when the double-lock member is in the temporary-latched position and second portions locking the electrical contacts in the contact cavities when the double-lock member is in the fully-latched position, and securing members on the housing and the locking member securing the double-lock member on the housing when the double-lock member is moved to the fully-latched position.

It is desirable that the arms of the double-lock member are joined at one end and that each arm can slide on the respective outer surface of the side walls of the housing. It is also desirable that at the end where the arms are connected together a checking device is provided which indicates that the double-lock member has reached the fully-latched position.

It is also desirable that each arm has a latching member which would make it possible to latch the double-lock member in the temporary-latched position and in the fully-latched position relative to the housing. The housing must have notches engaging the latching members which latch themselves by spring-loaded action.

It is further desirable that the arms of the double-lock member slide along guiding surfaces provided in the outer surfaces of side walls of the housing. It is preferable that such guiding surfaces be perpendicular to the side walls of the housing.

It is additionally desirable that windows are provided in the housing through which it is possible to confirm that the contacts are properly inserted in the contact cavities when the double-lock member is in the temporary-latched position. These confirmation windows can be closed by the double-lock member when it is moved to the fully-latched position.

BRIEF DESCRIPTION OF THE DRAWINGS

The invention will now be described by way of example with reference to the accompanying drawings in which:

FIG. 3 is a perspective view of an assembled double-lock connector shown in FIG. 1 showing the double-lock member in the temporary-latched position.

DETAILED DESCRIPTION

Figure 1:
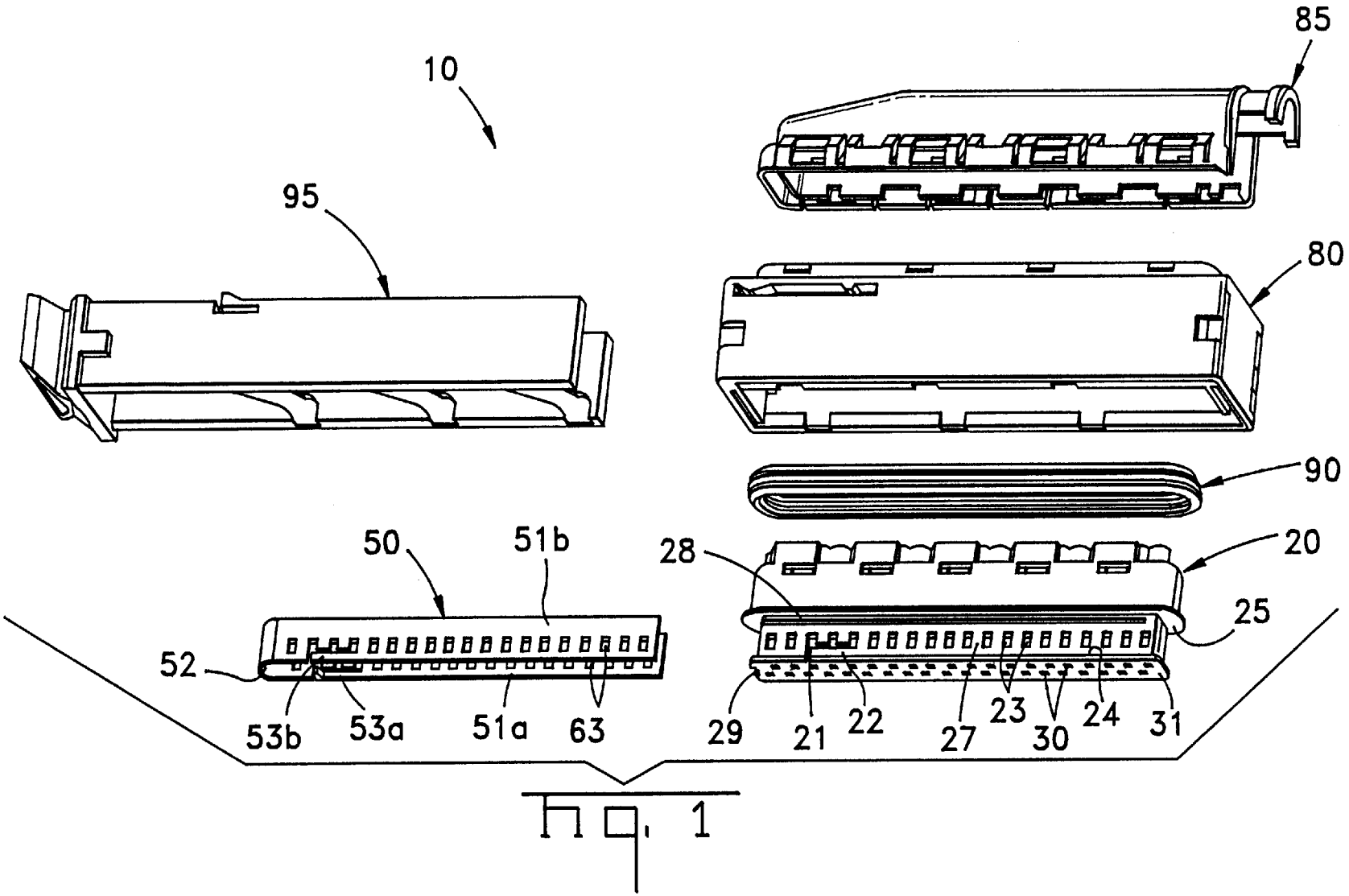
FIG. 1 is an exploded perspective view of a double-lock connector according to the present invention.

The double-lock connector 10 shown in FIG. 1 has an inner housing 20 containing multiple electrical contacts (not shown), an outer housing 80 in which the inner housing 20 is disposed and a wire housing 85 mounted to the back surface of the outer housing 80. To the inner housing 20, the double-lock member 50 and a waterproof gasket are mounted. A slide cam lever 95 is mounted on the exterior housing 80 which makes it possible to effect connection with a mating connector with an easy effort.

Figure 2:
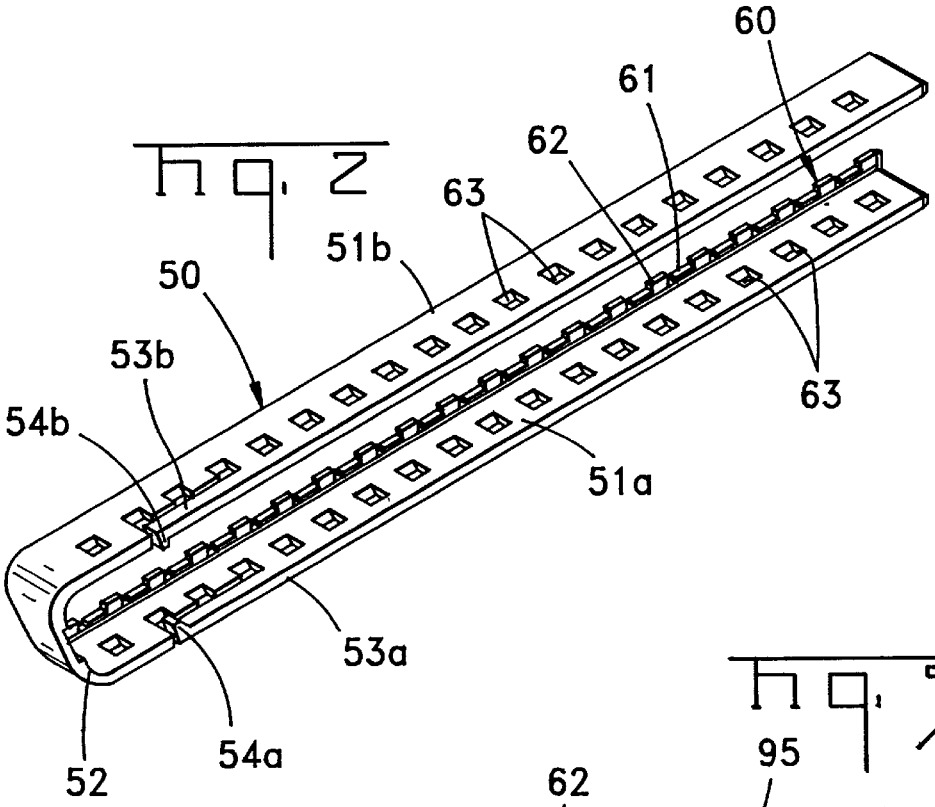
FIG. 2 is a perspective view of the double-lock member used in the double-lock connector depicted in FIG. 1.

As can be seen from FIG. 2, the double-lock member 50 has a generally U-shaped configuration and comprises two flat elongated arms 51*a*, 51*b* joined together at one end by means of a connection portion 52. On the arm 51*a*, locking members 60 facing inside are formed at fixed distances from each other in a longitudinal direction. Each locking member 60 includes two portions; the first, a relatively-low portion 61 which provides for the insertion of the contact into its cavity when the double-lock member is in the temporary-latched position, and the second, a relatively-high portion 62, which locks the contact in its cavity when the double-lock member is in the fully-latched position. Identical multiple locking members 60 are formed also on the other arm 51*b* facing the locking members on arm 51*a* (which cannot be seen in the drawing). In arms 51*a* and 51*b*, multiple windows 63 are located, which are located next to first portions 61 of the locking members 60. The purpose of windows 63 will be explained below. Near the connecting portion 52, latching arms 53*a*, 53*b* are provided in the arms 51*a*, 51*b* which have flexibility in the direction of the thickness of the arms. Latching lugs 54*a*, 54*b* are located at the ends of the latching arms 53*a*, 53*b*.

Figure 4:
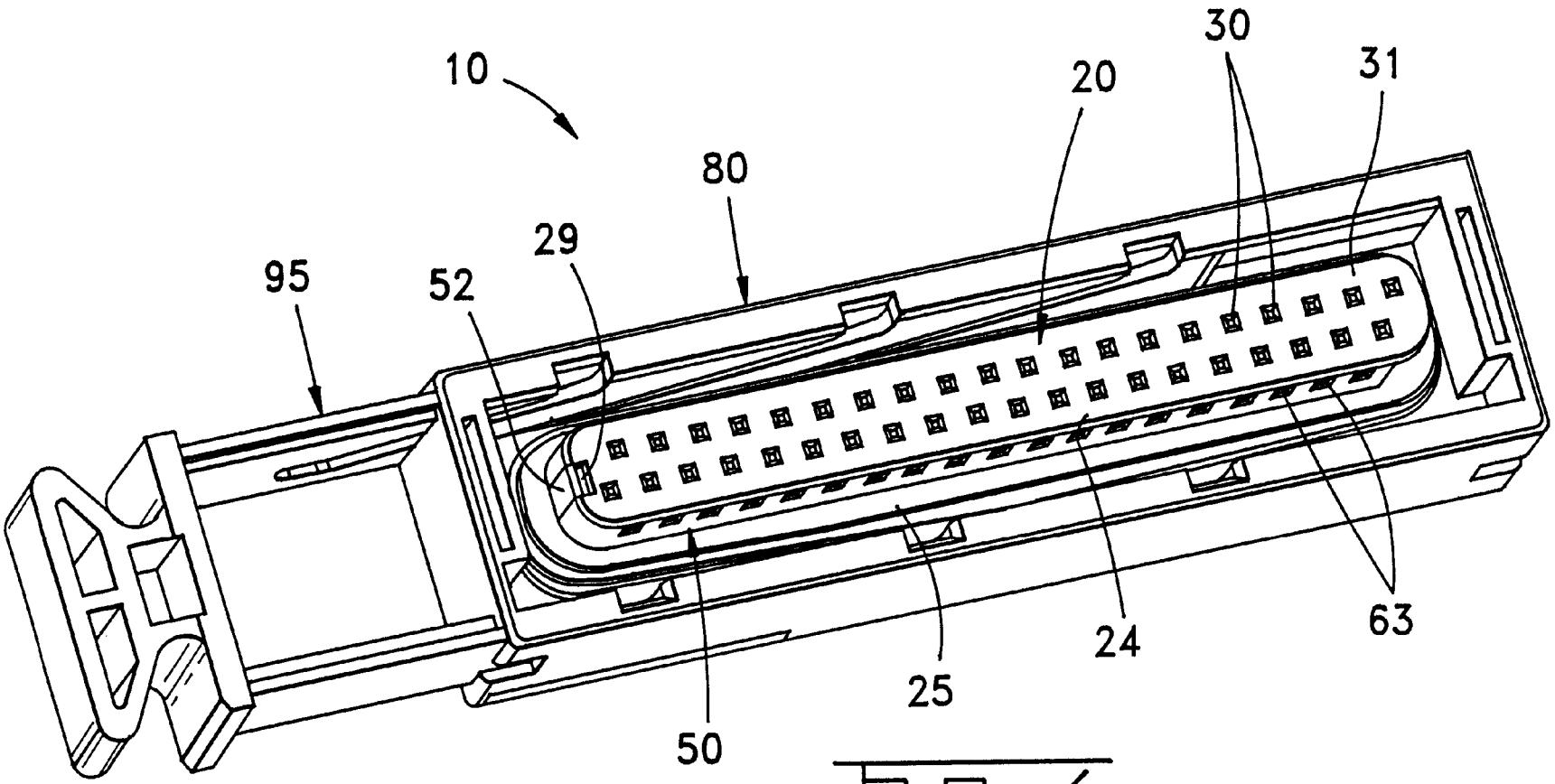
FIG. 4 is a view similar to that shown in FIG. 3 with the double-lock member in the fully-latched position.

The double-lock member 50 can move from the temporary-latched position shown in FIG. 3 to the fully-latched position shown in FIG. 4. As can be seen from FIG. 1, in the inner housing 20, notches 21, 22 are provided as a means for retaining the double-lock member 50 in the temporary-latched position and in the fully-latched position, respectively. In the temporary-latched position, latching lugs 54*a*, 54*b* of the latching arms 53*a*, 53*b* are engaged with the notches 21; and, in the fully-latched position, they are engaged with the notches 22.

As can be seen from FIGS. 1, 3 and 4, the double-lock member 50 can slide along the groove 27 formed in the inner housing 20 between a first wall 24, which is located closer to a mating surface 31 and a second wall 25, which is located inwardly from the first wall 24 on the housing. The first wall 24 and the second wall 25 act as a guiding means for the arms 51*a*, 51*b* of the double-lock member 50.

When the double-lock member 50 is in the temporary-latched position shown in FIG. 3, the electrical contacts (not shown) are inserted in cavities 30 of the inner housing 20 from the side opposite to the mating surface 31. As can be seen from FIG. 1, multiple windows 23 are formed in the side walls of the inner housing 20 whose locations correspond to the locations of cavities 30. In the temporary-latched position shown in FIG. 3, windows 63 of the double-lock member 50 are 35 aligned with the windows 23. Therefore, the insertion of contacts can be monitored through windows 23, 63. Since in the fully-latched position, as can be seen from FIG. 4, windows 23 and 63 are not aligned, no foreign matter can enter the contact cavities (see FIG. 5).

Figure 5:
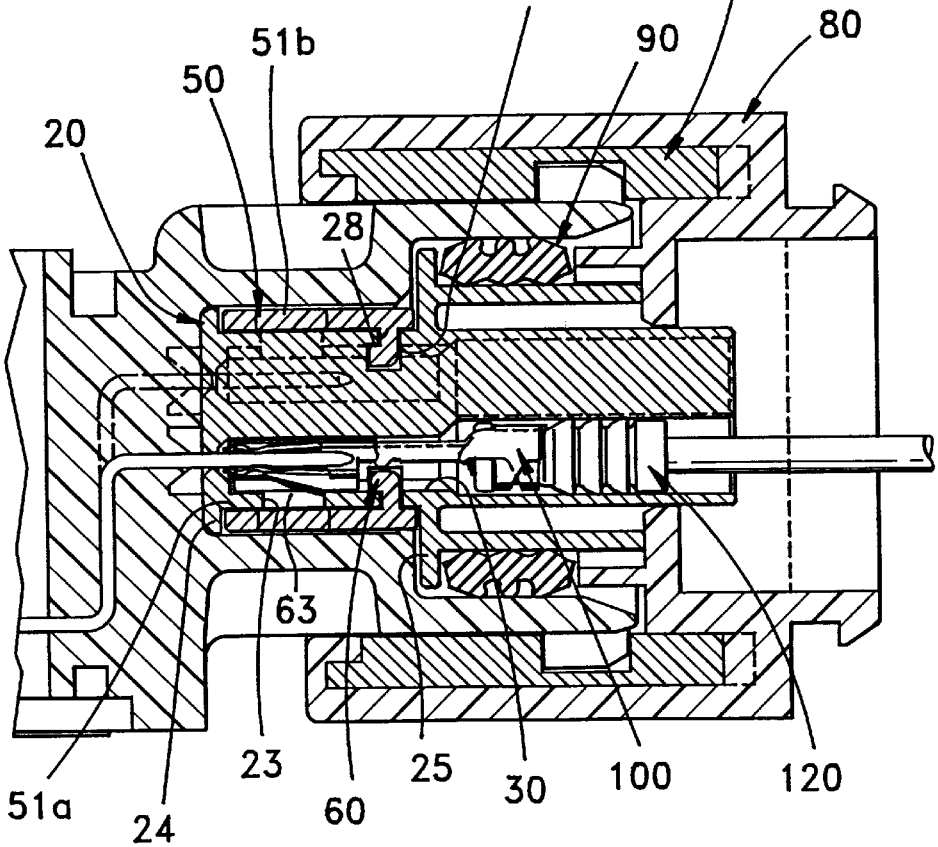
FIG. 5 is a cross-sectional view of the double-lock connector shown in FIG. 1 with the double-lock member in the fully-latched position and with the connector connected to a mating connector.
Figure 7:
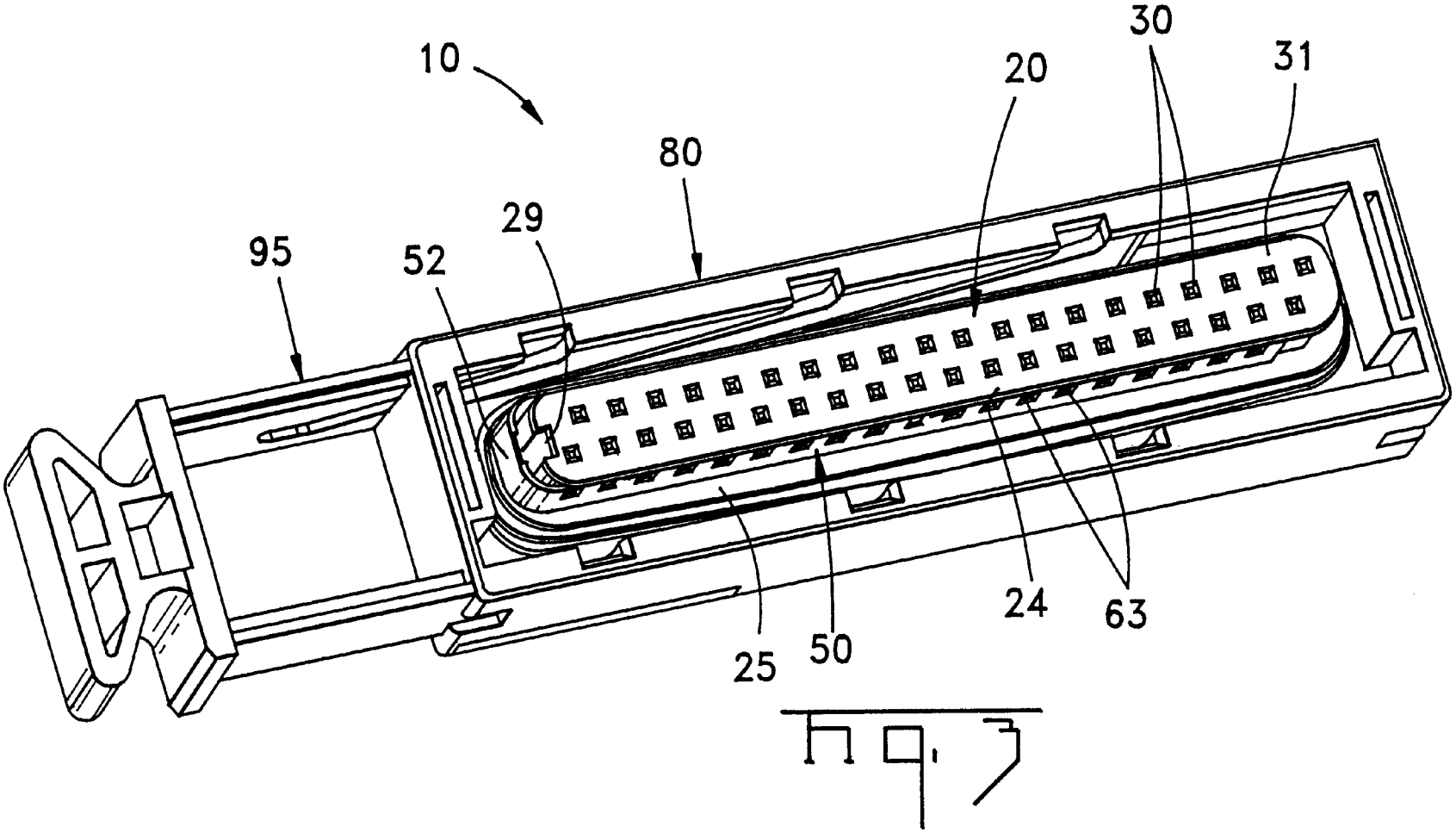

As shown in FIG. 5, the second portion 62 of the locking member 60 of the double-lock member 50, whose purpose is to retain an electrical contact 100 in the cavity 30, has an L-shaped cross section. From FIG. 2, it is clear that the cross section of the first portion 61 is also of an L-shaped configuration. On the other hand, one can see that the locking members 60 fit into an L-shaped groove 28 formed along the entire length of the inner housing 20. Therefore, when the double-lock member 50 is moved from the temporary-latched position to the fully-latched position, as shown in FIGS. 3 and 4, arms 51*a*, 51*b* are maintained in position on housing 20 as a result of the engagement between the locking members 60 and the groove 28. The engagement between the locking members 60 and the groove 28 also plays the role of a guiding means.

As can be seen from FIGS. 1, 3 and 4, cavities 30 are arranged in a staggered pattern. This increases the density of seal members 120 provided at the rear ends of the contacts 100, thus making it possible to reduce the dimension of the inner housing 20.

As can be seen from FIGS. 1, 3 and 4, at one end of the first wall 24 of the inner housing 20, a cutout 29 is provided. Through cutout 29, it is possible to ascertain that the double-lock member 50 is in the fully-latched position by the position of the connecting portion 52. In addition, the first wall 24 plays the role of a cover protecting the double-lock member 50 from been exposed to the mating surface 31, except for the portion engaging the cutout 29, thus preventing possible damage to the double-lock member 50.

Above, a detailed explanation concerning the double-lock connector according to this invention has been presented. However, this explanation was provided only as an example, and experts in the field can make various modifications and changes. For example, in this embodiment, the first and the second portions 61 and 62 of the locking members 60 have an L-shaped cross section, however, it is possible to make only the first portion 61 of the L-shaped configuration.

The double-lock connector, according to this invention, has a double-lock member with elongated arms extending in the direction of sliding with L-shaped locking members locking the contacts in contact cavities when the double-lock member is in the fully-latched position, which are arranged at fixed distances from each other. A groove of L-shaped cross section is formed along an outside surface of a housing thereby retaining the arms on the housing when the double-lock member is slid by engaging with the locking members. Therefore, it can be used not only in connectors having the contacts arranged in regular rows but also in connectors having contacts arranged in a staggered pattern and provides for a smooth movement of the double-lock member from a temporary-latched position to a fully-latched position.

I claim:

1. A double-lock connector comprising a housing (20) having contact cavities (30) for receiving electrical contacts (100) therein, a double-lock member (50) mounted on the housing (20) for locking the electrical contacts (100) in the contact cavities (30), characterized in that the double-lock member (50) has an elongated arm (51*a*, 51*b*) slidable along an outer surface of the housing (20) from a temporary-latched position to a fully-latched position, locking members (60) on an inside surface of the double-lock member at spaced intervals therealong and having first portions (61) permitting insertion of the electrical contacts (100) in the contact cavities (30) when the double-lock member (50) is in the temporary-latched position and second portions (62) locking the electrical contacts (100) in the contact cavities (30) when the double-lock member (50) is in the fully-latched position, and securing members (28, 62) on the housing (20) and the locking members (60) securing the double-lock member (50) on the housing (20) when the double-lock member (50) is moved to the fully-latched position.

2. A double-lock connector as claimed in claim 1, wherein the double-lock member (50) and the housing (20) have check members (52, 29) to ascertain that the double-lock member is at the fully-latched position.

3. A double-lock connector as claimed in claim 1, wherein the double-lock member (50) has two elongated arms (51*a*, 51*b*) connected together at one end by a connection portion (52).

4. A double-lock connector as claimed in claim 3, wherein the double-lock member (50) includes flexible latching members (53*a*, 53*b*) having latching lugs (54*a*, 54*b*) engagable with notches (21, 22) on the housing (20) for latching the double-lock member (50) at the temporary-latched position and the fully-latched position.

5. A double-lock connector as claimed in claim 3, wherein the housing (20) and the double-lock member (50) have windows (20, 63) that are aligned when the double-lock member (50) is in the temporary-latched position to confirm that the electrical contacts (100) are properly inserted in the contact cavities (30).

6. A double-lock connector as claimed in claim 1, wherein the first portions (61) are lower in height than the second portions (62).

7. A double-lock connector as claimed in claim 6, wherein the second portions (62) have an L-shaped cross section.

8. A double-lock connector as claimed in claim 7, wherein the securing members comprise an L-shaped groove (28) on side walls of the housing (20) and the L-shaped second portions (62) of the locking members (60) in engagement with each other.

* * * * *